US009227410B2

(12) United States Patent
Shindo et al.

(10) Patent No.: US 9,227,410 B2
(45) Date of Patent: Jan. 5, 2016

(54) LIQUID JETTING APPARATUS

(71) Applicants: Tatsuya Shindo, Nagoya (JP); Masayuki Takata, Nagoya (JP)

(72) Inventors: Tatsuya Shindo, Nagoya (JP); Masayuki Takata, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/187,543

(22) Filed: Feb. 24, 2014

(65) Prior Publication Data

US 2014/0240395 A1 Aug. 28, 2014

(30) Foreign Application Priority Data

Feb. 25, 2013 (JP) ..... 2013-034288

(51) Int. Cl.
*B41J 2/165* (2006.01)

(52) U.S. Cl.
CPC ..... *B41J 2/16523* (2013.01); *B41J 2/16505* (2013.01); *B41J 2002/16573* (2013.01)

(58) Field of Classification Search
CPC ..... B41J 2/16523; B41J 2/16508
USPC ..... 347/29, 30, 31, 40, 47
See application file for complete search history.

(56) References Cited

U.S. PATENT DOCUMENTS

| | | | | |
|---|---|---|---|---|
| 7,735,962 | B2 * | 6/2010 | Matsumoto et al. | 347/40 |
| 8,226,204 | B2 * | 7/2012 | Sato | 347/29 |
| 2004/0155920 | A1 * | 8/2004 | Umeda et al. | 347/30 |
| 2006/0132533 | A1 | 6/2006 | Mochizuki | |
| 2006/0203032 | A1 * | 9/2006 | Takagi | 347/29 |
| 2007/0126779 | A1 * | 6/2007 | Kyoso | 347/29 |
| 2007/0176962 | A1 | 8/2007 | Ogawa | |
| 2008/0192083 | A1 * | 8/2008 | Nishida | 347/30 |
| 2010/0128084 | A1 | 5/2010 | Nakazawa | |
| 2010/0194819 | A1 * | 8/2010 | Tamaki | 347/29 |
| 2011/0298875 | A1 * | 12/2011 | Kobashi et al. | 347/92 |

FOREIGN PATENT DOCUMENTS

| | | |
|---|---|---|
| JP | 2004-291326 | 10/2004 |
| JP | 2006-44146 | 2/2006 |
| JP | 4062991 | 1/2008 |
| JP | 2010-125635 | 6/2010 |
| JP | 4725084 | 4/2011 |
| JP | 4826745 | 9/2011 |

* cited by examiner

*Primary Examiner* — Matthew Luu
*Assistant Examiner* — Patrick King
(74) *Attorney, Agent, or Firm* — Frommer Lawrence & Haug LLP

(57) ABSTRACT

A liquid jetting apparatus includes a liquid jetting head having a liquid jetting surface in which a first nozzle row and a second nozzle row are formed, each of the first nozzle row and the second nozzle row including a plurality of nozzles aligned in a predetermined direction, a cap member configured to be in a close contact with the liquid jetting surface to cover the first and second nozzle rows, a liquid discharge section connected to the cap member, a liquid guiding member accommodated in the cap member, and a control unit configured to control the liquid jetting head to jet a liquid from each of the first and second nozzle rows. First and second liquid receiving grooves extending in the predetermined direction are formed in a facing surface of the liquid guiding member configured to face the liquid jetting surface.

13 Claims, 16 Drawing Sheets

LIQUID JETTING APPARATUS

CROSS REFERENCE TO RELATED APPLICATION

The present application claims priority from Japanese Patent Application No. 2013-034288, filed on Feb. 25, 2013, the disclosure of which is incorporated herein by reference in its entirety.

BACKGROUND OF THE INVENTION

1. Field of the Invention

The present invention relates to a liquid jetting apparatus.

2. Description of the Related Art

As an example of a liquid jetting apparatus, an ink-jet recording apparatus, which includes an ink-jet head having a plurality of nozzles and a cap member which is to be used for restoring a jetting function of the nozzles of the ink-jet head, has been known. The cap member is to be installed on an ink-jetting surface of the ink-jet head to cover the plurality of nozzles (capping). Moreover, a suction pump is connected to the cap member. When the cap member is in a capping state, ink is discharged from the plurality of nozzles forcibly by generating a negative pressure in an internal space of the cap member by the suction pump, and a jetting defect of a nozzle is eliminated (suction purge).

The ink discharged from the plurality of nozzles by the suction purge is accumulated inside the cap member. Therefore, after releasing the inside of the cap member to atmosphere after the suction purge, the ink inside the cap member is to be sucked by the suction pump, and to be discharged from the cap member. In the ink-jet recording apparatus, for facilitating the discharge of ink from the inside of the cap member, a liquid guiding member (an ink guiding member) has been accommodated inside the cap member. By the liquid guiding member being arranged inside the cap member, a gap (channel) is formed between an inner surface of the cap member and the liquid guiding member. Accordingly, a capillary force acts on the ink inside the cap member, and the ink is susceptible to be guided to a discharge port formed in a bottom portion of the cap member.

SUMMARY OF THE INVENTION

The cap member had been provided for carrying out suction purge for eliminating jetting defects of the plurality of nozzles. However, the inventors of the present invention have reviewed using the cap member as a liquid receiver when a flushing of the nozzles is performed. The flushing means, in general, jetting the liquid from the nozzles continuously for a plurality of times in order to discharge a thickened liquid or the like inside the nozzle.

At the time of flushing, in a case in which the liquid guiding member is arranged inside the cap member as in the ink-jet recording apparatus, the following problem arises. When the flushing is carried out from the plurality of nozzles toward the cap member in which the liquid guiding member is accommodated, ink jetted from each of the nozzles is adhered to a surface of the liquid guiding member. It is necessary to discharge the ink accumulated inside the cap member by flushing similar to the case of the suction purge. However, unlike the ink entered into a gap between the cap member and the liquid guiding member, there is no capillary force acting on the ink adhered to the surface of the liquid guiding, and therefore, the ink adhered to the surface of the liquid guiding member is not discharged and is susceptible to be remained.

If this state is left as it is, when the cap member is brought to a capping state for carrying out the suction purge, there is a possibility that the ink remained on the surface of the liquid guiding member is adhered to an ink jetting surface of the ink-jet head.

An object of the present invention is to prevent the liquid from remaining on the surface of the liquid guiding member when the cap member, in which the liquid guiding member is accommodated, is used as a liquid receiver which receives the liquid which is flushed.

According to an aspect of the present invention, there is provided a liquid jetting apparatus including a liquid jetting head having a liquid jetting surface in which a first nozzle row and a second nozzle row are formed, each of the first nozzle row and the second nozzle now including a plurality of nozzles aligned in a predetermined direction; a cap member configured to be in a close contact with the liquid jetting surface to cover the first nozzle row and the second nozzle row; a liquid discharge section connected to the cap member; a liquid guiding member accommodated in the cap member; and a control unit configured to control the liquid jetting head to jet a liquid from each of the first nozzle row and the second nozzle row, wherein a first liquid receiving groove extending in the predetermined direction and a second liquid receiving groove extending in the predetermined direction and having a volume smaller than a volume of the first liquid receiving groove are formed in a facing surface of the liquid guiding member, the facing surface being configured to face the liquid jetting surface, and the control unit is configured to control the liquid jetting head to jet the liquid from the first nozzle row toward the first liquid receiving groove and to jet the liquid from the second nozzle row toward the second liquid receiving groove at a time of flushing of the nozzles, and the control unit is configured to control the liquid jetting head such that, at the time of flushing, an amount of liquid jetted from the first nozzle row toward the first liquid receiving groove is greater than an amount of liquid jetted from the second nozzle row toward the second liquid receiving groove.

In the liquid jetting apparatus according to the aspect of the present invention, the first nozzle row and the second nozzle row are formed in the liquid jetting surface of the liquid jetting head. On the other hand, the first liquid receiving groove and the second liquid receiving groove corresponding to the first nozzle row and the second nozzle row respectively are formed in the facing surface facing the liquid jetting surface of the liquid guiding member accommodated inside the cap member. At the time of flushing, the liquid is jetted from the first nozzle row to the first liquid receiving groove and the liquid is jetted from the second nozzle row to the second liquid receiving groove. Accordingly, a majority of amount of the liquid jetted from the first nozzle row and the second nozzle row is accumulated in the first liquid receiving groove and the second liquid receiving groove respectively. Moreover, since a capillary force acts on the liquid in each of the first liquid receiving groove and the second liquid receiving groove, the discharge of the liquid from the cap member to the liquid discharge section is facilitated. Accordingly, the liquid adhered to the liquid guiding member is suppressed from remaining on the liquid guiding member. Moreover, the amount of liquid jetted to the first liquid receiving groove is greater than the amount of liquid jetted to the second liquid receiving groove. Regarding this point, in the liquid jetting apparatus according to the aspect of the present invention, since the volume of the first liquid receiving groove is greater than the volume of the second liquid receiving groove, the liquid jetted to the first liquid receiving groove is suppressed from overflowing from the groove.

DETAILED DESCRIPTION OF THE PREFERRED EMBODIMENTS

Figure 1:
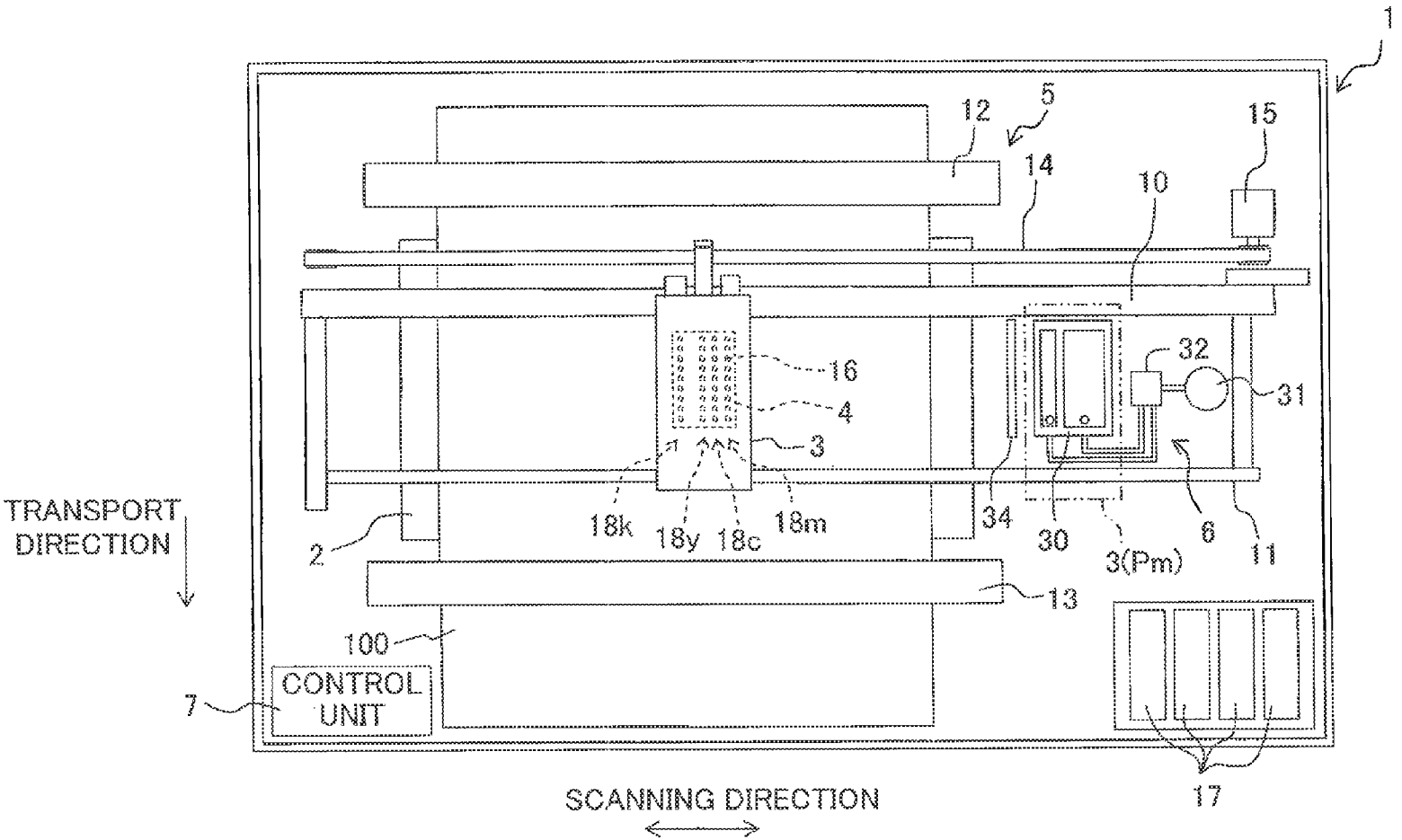
FIG. 1 is a plan view showing a schematic structure of an ink-jet printer according to an embodiment of the present invention.

Next, an embodiment of the present invention will be described below. The embodiment described below is an example in which, the present invention is applied to an inkjet printer which prints an image and the like by jetting droplets of ink onto a recording paper. Hereinafter, a frontward side of a paper surface of FIG. 1 will be defined as an "upward", and a rearward side of the paper surface of FIG. 1 will be defined as a "downward", and the description will be made by using direction terminology of "upward" and "downward". As shown in FIG. 1, an ink-jet printer 1 (liquid jetting apparatus) includes a platen 2, a carriage 3, an inkjet head 4 (liquid jetting head), a transporting mechanism 5, a maintenance mechanism 6, and a control unit 7, etc.

A recording paper 100, which is a recording medium, is to be placed on an upper surface of the platen 2. The carriage 3 is arranged to be capable of reciprocating movement in a scanning direction along two guide rails 10 and 11 in an area facing the platen 2. An endless belt 14 is linked to the carriage 3, and the carriage 3 moves in the scanning direction by the endless belt 14 being driven by a carriage driving motor 15.

The inkjet head 4 is installed on the carriage 3 and moved along with the carriage 3 in the scanning direction. The inkjet head 4 is connected to ink cartridges 17 of four colors (black (K), yellow (Y), cyan (C), and magenta (M)) installed on the printer 1 by tubes which are not shown in the diagram. In the embodiment, out of the inks of four colors, the black ink is a pigment ink and the other color inks of three colors are dye inks.

Moreover, a plurality of nozzles 16 are formed in a lower surface (a surface on a rearward side of the paper surface in FIG. 1) of the ink-jet head 4. In other words, the lower surface of the ink-jet head 4 in which the plurality of nozzles 16 are formed is an ink jetting surface 4*a* (liquid jetting surface: refer to FIG. 4). The plurality of nozzles 16 in the ink jetting surface 4*a* are arranged in rows along a transport direction and forms four nozzle rows 18 arranged in the scanning direction. Inks of four colors in the four ink cartridges are supplied to the four nozzle rows 18, respectively. Alphabets "k", "y", "c", and "in" in reference numerals of the four nozzle rows 18 (18*k*, 18*y*, 18*c*, and 18*m*) indicate that the alphabets correspond to black, yellow, cyan, and magenta colors respectively. Moreover, the inks of three colors other than black namely, yellow, cyan, and magenta will be called specifically as color inks. The ink-jet head 4 jets inks of four colors from the four nozzle rows 18*k*, 18*y*, 18*c*, and 18*m* onto the recording paper 100 placed on the platen 2.

In the ink jetting surface 4*a*, out of the four nozzle rows 18, there is a space between the nozzle row 18*k* for the black ink and the nozzle rows 18*y*, 18*c*, and 18*m* for the color inks (yellow, cyan, and magenta). In other words, between the nozzle row 18*k* for the black ink and the nozzle rows 18*y*, 18*c*, and 18*m*, there exists a wide area in which no nozzle 16 has been formed. This is for securing an area for a partition wall portion 30*c* of a cap member 30 to abut without interfering with the nozzles 16, when the cap member 30 of the maintenance mechanism 6 which will be described later is installed on the ink jetting surface 4*a* (refer to FIG. 4). The partition wall portion 30*c* divides the cap member 30 into a first cap portion 41 for the black ink and a second cap portion 42 for the color inks.

The transporting mechanism 5 includes two transporting rollers 12 and 13 arranged to sandwich the platen 2 in the transport direction. The two transporting rollers 12 and 13 are driven in synchronization by a transporting motor 19 (refer to FIG. 2). The transporting mechanism 5 transports the recording paper 100 placed on the platen 2 in the transport direction by the two transporting rollers 12 and 13.

Next, the maintenance mechanism 6 will be described below. The maintenance mechanism 6 is arranged at a position on an outer side (right side in FIG. 1) of an area facing the recording paper 100, within a moving range of the carriage 3 in the scanning direction. The maintenance mechanism 6 includes the cap member 30, an ink discharge section 37 (suction mechanism), a cap driving motor 33 (refer to FIG. 2), and a wiper 34.

The cap member 30 is driven in a vertical direction (a direction perpendicular to the paper surface in FIG. 1) by the cap driving motor 33. After the carriage 3 has moved to a position right above the maintenance mechanism 6 (hereinafter, called as a "maintenance position Pm") shown by alternate long and two short dashes lines, the cap member 30 is driven upward by the cap driving motor 33 in a state that the ink jetting surface 4*a* of the inkjet head 4 faces the cap member 30, and covers the plurality of nozzles 16 by making a close contact with the ink jetting surface 4*a* (capping). A concrete structure of the cap member 30 will be described later in detail.

Figure 4:
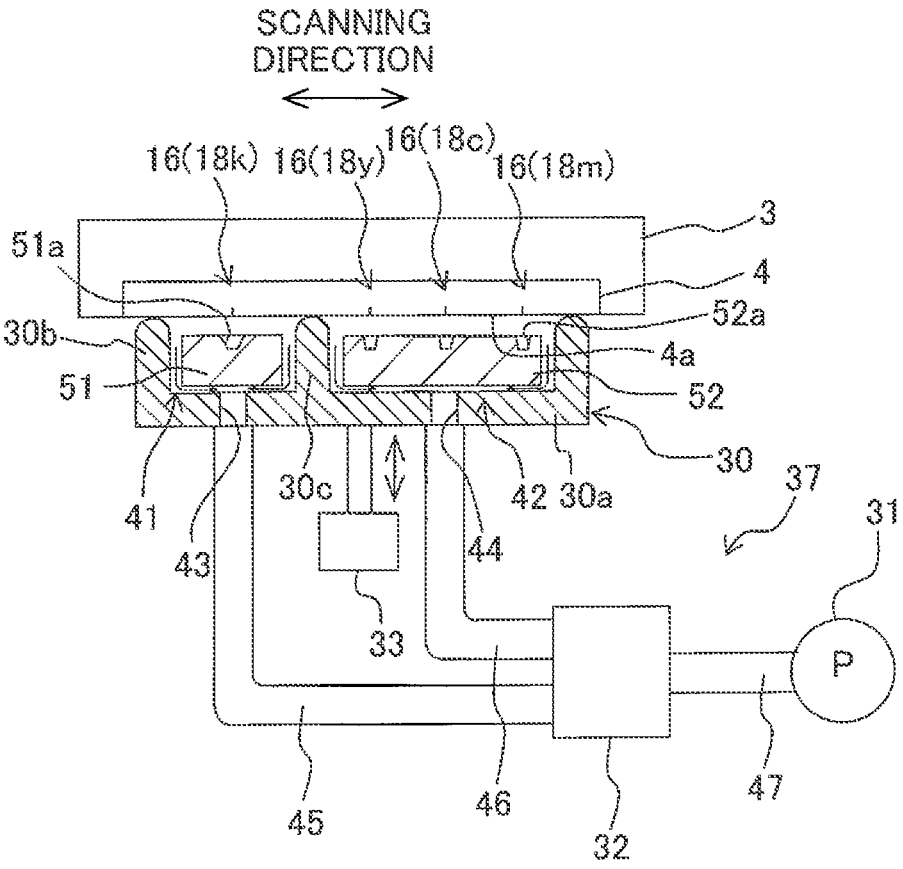
FIG. 4 is a diagram showing an ink-jet head and the cap member in a capping state.

As shown in FIG. 4, the ink discharge section 37 including a suction pump 31 is connected to the cap member 30. The ink discharge section 37 discharges the ink discharged from the plurality of nozzles 16 to the cap member 30 to a waste-liquid tank (omitted in the diagram). The suction pump 31 is connected to the cap member 30 via tubes 45 to 47, and a switching unit 32. The switching unit 32, as it will be described later, switches a destination of the suction pump 31 between a first cap portion 41 and a second cap portion 42 of the cap member 30. In FIG. 4, the cap member 30 is shown in a cross-sectional view along a vertical plane including the scanning direction.

When the cap member 30 is in a capping state in FIG. 4, by operating the suction pump 31 to reduce a pressure inside the cap member, the ink is discharged forcibly from the plurality of nozzles 16 into the cap member 30. Hereafter, this ink discharge operation will be called as a "suction purge". By carrying out the suction purge, air bubbles and dust inside the ink-jet head 4, or the ink thickened due to drying are discharged from the plurality of nozzles 16. Accordingly, jetting defects of the nozzles 16 due to the air bubbles etc. are eliminated.

Moreover, the ink-jet head 4 discharges the dried ink inside the nozzles 16 by jetting the ink for a plurality of times continuously from each nozzle 16 at an appropriate timing such as before printing or during printing, onto the recording paper 100, in order to carry out a jetting operation favorably. The ink jetting operation is called as flushing in general. Moreover, in the embodiment, the cap member 30 is also used as a liquid receiving member which receives the ink jetted from the nozzles 16 at the time of flushing. In other words, in a state that the ink jetting surface 4*a* of the ink-jet head 4 faces the cap member 30, the ink-jet head 4 jets the ink toward the cap member 30 from the plurality of nozzles 16. An operation of the printer 1 at the time of carrying out the suction purge and flushing will be described later in detail.

As shown in FIG. 1, the wiper 34 is erected at a position between the platen 2 and the cap member 30. After the suction purge, by moving the carriage 3 toward the scanning direction in a state that a front end of the wiper 34 contacts the ink jetting surface 4*a*, the wiper 34 moves relative to the ink jetting surface 4*a*, and at this time, the wiper 34 wipes off the ink adhered to the ink jetting surface 4*a*.

Figure 2:
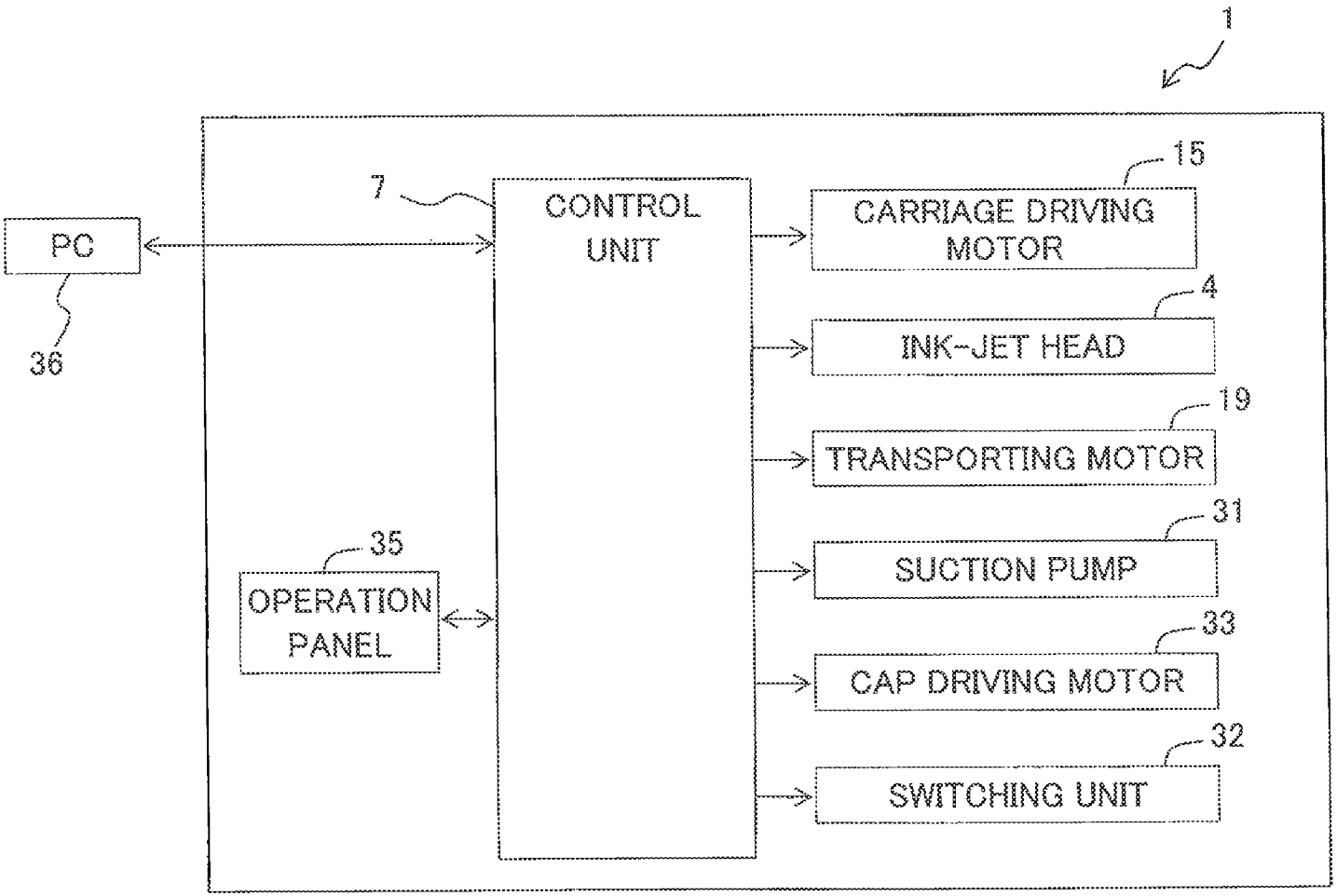
FIG. 2 is a block diagram showing schematically a control system of the ink-jet printer.

As shown in FIG. 2, the control unit 7 includes a CPU (Central Processing Unit), a ROM (Read Only Memory), a RAM (Random Access Memory), and an ASIC (Application Specific Integrated Circuit) which includes various control circuits. The control unit 7 is connected to various units or driving sections of the printer 1, such as the ink-jet head 4, the carriage driving motor 15, the transporting motor 19, the suction pump 31, the switching unit 32, and the cap driving motor 33. Moreover, the control unit 7 is connected to an operation panel 35 and a PC (personal computer) 36 which is an external device.

The control unit 7, according to a computer program stored in the ROM, executes various processing by the CPU and the ASIC. To cite an example, the control unit 7, based on a print command transmitted from the PC 36, controls components such as the inkjet head 4 and the carriage driving motor 15 to print an image etc. on the recording paper 100. Moreover, control unit 7 controls components such as the suction pump 31 and the cap driving motor 33 of the maintenance mechanism 6 to carry out the suction purge. Moreover, the control unit 7 controls components such as the ink-jet head 4 and the carriage driving motor 15 to carry out flushing toward the cap member 30 from the plurality of nozzles 16 of the inkjet head 4. The example in which the control unit 7 carries out various processing by using the CPU and the ASIC has been cited above. However, the present invention is not restricted to this example, and the control unit 7 may be realized by any hardware configuration. For instance, the processing may be carried out only by the CPU or only by the ASIC. Moreover, the control unit 7 may be realized by making two or more CPUs and two or more ASICs share functions.

Next, concrete structure of the cap member 30, and the flushing and the suction purge of the inkjet head 4 using the cap member 30 will be described in detail.

Figure 3:
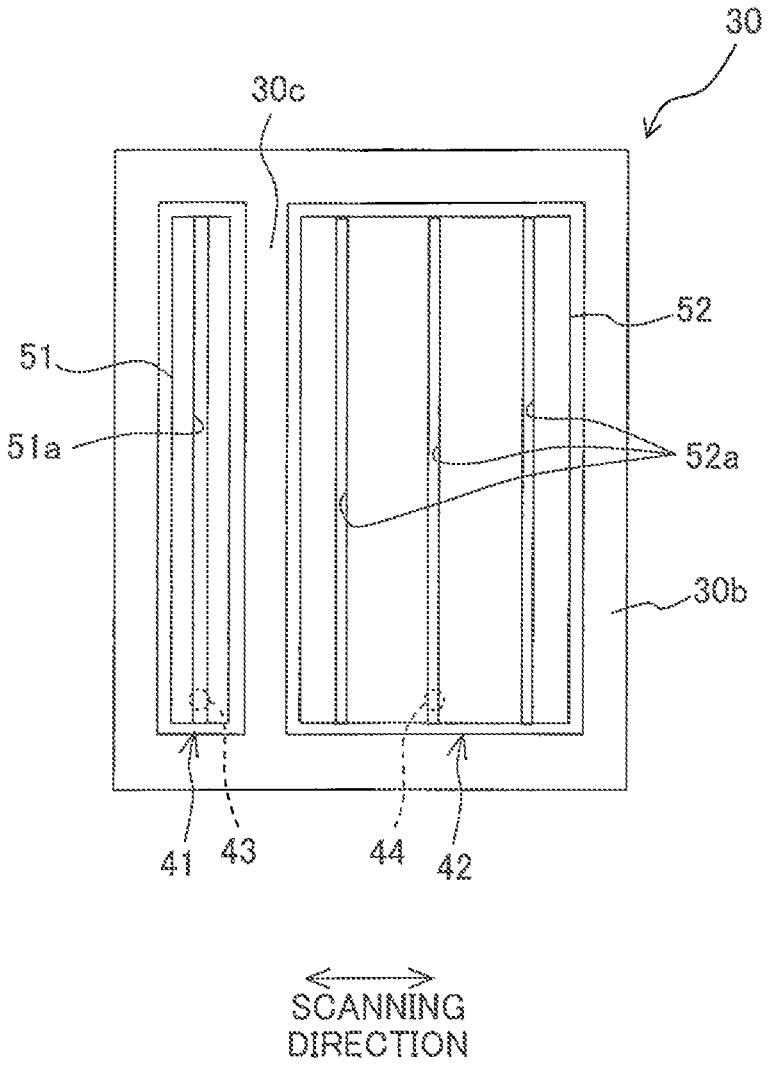
FIG. 3 is a top view of a cap member.

As shown in FIG. 3 and FIG. 4, the cap member 30 includes a bottom wall portion 30*a* and a lip portion 30*b* provided to an outer circumferential portion of the bottom wall portion 30*a*. The cap member 30 is formed of a material having elasticity, such as rubber or a synthetic resin. Moreover, by dividing an inner-side space of the cap member 30 surrounded by the lip portion 30*b* by a partition wall portion 30*e*, the first cap portion 41 and the second cap portion 42 are formed. At the time of capping, the first cap portion 41 covers the nozzle row 18*k* for black ink and the second cap portion 42 covers the nozzle rows 18*y*, 18*c*, and 18*m* for color inks. Moreover, the partition wall portion 30*c* abuts against an area, between the nozzle row 18*k* for black ink and the nozzle rows 18*y*, 18*c*, and 18*m* for color inks, in which the nozzles 16 are not formed. In the embodiment, the nozzle row 18*k* for black ink corresponds to a "first nozzle row" of the present invention, and the nozzle rows 18*y*, 18*c*, and 18*m* for color inks correspond to a "second nozzle row".

Because the first cap portion 41 and the second cap portion 42 are isolated by the partition wall portion 30*c*, the black ink jetted from the nozzle row 18*k* and the color inks of three colors jetted from the nozzle rows 18*y*, 18*c*, and 18*m* are prevented from getting mixed. Particularly, in the embodiment, the black ink is a pigment ink and the color inks of three colors are dye inks. According to the above described structure of the cap member 30, aggregation of a pigment component by the dye ink being mixed with the pigment ink is prevented.

As shown in FIG. 4, suction ports 43 and 44 are formed in a bottom wall portion of the first cap portion 41 and a bottom wall portion of the second cap portion 42, respectively. The two suction ports 43 and 44 are connected to the switching unit 32 by the tubes 45 and 46 respectively, and furthermore, the switching unit 32 is connected to the suction pump 31 by the tube 47. The switching unit 32 has a switching valve (not shown in the diagram) at an interior thereof, and switches the destination (access point) of the suction pump 31 between the first cap portion 41 and the second cap portion 42. Accordingly, the suction purge of the nozzle row 18*k* for black ink and the suction purge for the nozzle rows 18*y*, 18*c*, and 18*m* for color inks are carried out separately.

A first ink guiding member 51 (first liquid guiding member) and a second ink guiding member 52 (second liquid guiding member) are accommodated in the first cap portion 41 and the second cap portion 42 of the cap member 30, respectively. As shown in FIG. 3, both the first ink guiding member 51 and the second ink guiding member 52 are members in the form of a plate having a rectangular shape, and planar sizes thereof are slightly smaller than the first cap portion 41 and the second cap portion 42 in which they are accommodated, respectively. Moreover, each of the first ink guiding member 51 and the second ink guiding member 52 is formed of a hard resin, and is a member having stiffness (rigidity) higher than that of the cap member 30. In such manner, by the first ink guiding member 51 and the second ink guiding member 52 being accommodated in the first cap portion 41 and the second cap portion 42 respectively, the cap member 30 made of a material such as rubber is prevented from being deformed due to pressure reduction at the time of the suction purge. Moreover, as shown in FIG. 4, a narrow channel leading to the suction port 43 is formed between an inner surface of the first cap portion 41 and the first ink guiding member 51, and a narrow channel leading to the suction port 44 is formed between an inner surface of the second cap portion 42 and the second ink guiding member 52. In such manner, by the first ink guiding member 51 and the second ink guiding member 52 being accommodated in the first cap portion 41 and the second cap portion 42 respectively, a strong capillary force acts on the ink inside the first cap portion 41 and the second cap portion 42, and an effect of facilitated discharge of ink is also achieved.

One first ink receiving groove 51*a* (first liquid receiving groove) extending along a longitudinal direction of the first ink guiding member 51 is formed on a surface (an upper surface), of the first ink guiding member 51, which faces the ink jetting surface 4*a*. The first ink guiding member 51 is accommodated in the first cap portion 41 such that the first ink receiving groove 51*a* is along an arrangement direction of the nozzles 16 (the transport direction). The first ink receiving groove 51*a* extends up to two end portions in the longitudinal direction of the first ink guiding member 51. Moreover, three second ink receiving grooves 52*a* (second liquid receiving grooves) extending along a longitudinal direction of the second ink guiding member 52 are formed on a surface (an upper surface) of the second ink guiding member 52, which faces the ink jetting surface 4*a*. The second ink guiding member 52 is accommodated in the second cap portion 42 such that the second ink receiving grooves 52*a* are along an arrangement direction of the nozzles 16 (the transport direction). Each of the three second ink receiving grooves 52*a* extends up to two ends in the longitudinal direction of the second ink guiding member 52. The first ink receiving groove 51*a* and the three second ink receiving grooves 52*a* are arranged in the scanning direction corresponding to the four nozzle rows 18 of the ink-jet head 4, in a state that the first ink guiding member 51 and the second ink guiding member 52 are accommodated in the first cap portion 41 and the second cap portion 42 respectively.

As shown in FIG. 4, in a state that the ink jetting surface 4*a* of the ink-jet head 4 faces the cap member 30, the first ink receiving groove 51*a* is at a position just below the nozzle row 18*k* for black ink and faces the nozzles 16 belonging to this nozzle row 18*k*. Moreover, the three second ink receiving grooves 52*a* are at positions just below the nozzle rows 18*y*, 18*e*, and 18*m* for color inks and the three second ink receiving grooves 52*a* face the nozzles 16 belonging to the three nozzle rows 18*c*, and 18*m*, respectively.

Figure 5A:
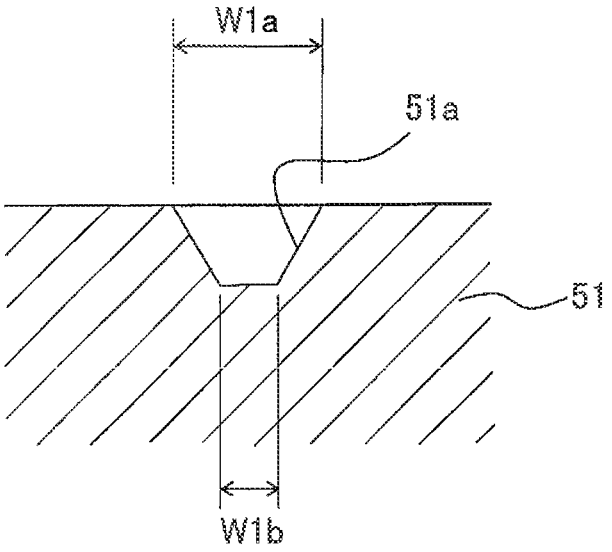
FIG. 5A is a cross-sectional view of a surface, of a first ink guiding member, orthogonal to a longitudinal direction of a first ink receiving groove.
Figure 5B:
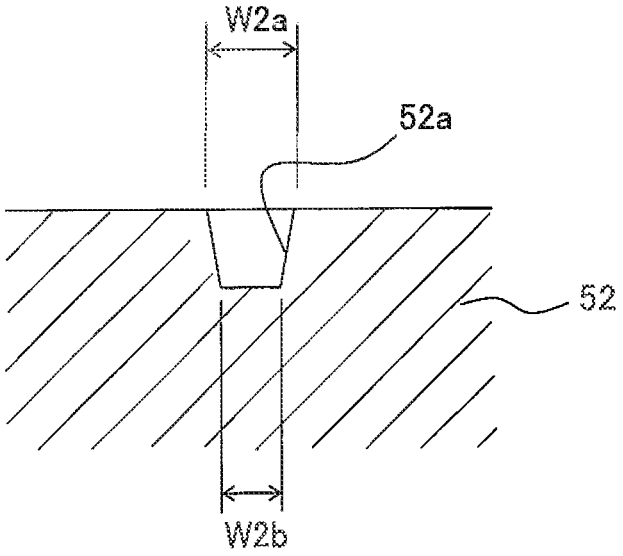
FIG. 5B is a cross-sectional view of a surface, of a second ink guiding member, orthogonal to a longitudinal direction of a second ink receiving groove.

As shown in FIG. 5A and FIG. 5B, cross-sectional shapes of both the first ink receiving groove 51*a* and the second ink receiving grooves 51*b* are tapered shapes in each of which a width of a bottom portion on a lower-end side is narrower than a width of an opening portion on an upper-end side. A "width" of the first ink receiving groove 51*a* and the second ink receiving groove 52*a* is a length in a direction orthogonal to the longitudinal direction of each of the first ink receiving groove 51*a* and the second ink receiving grooves 52*a*. Moreover, as shown in FIG. 5A and FIG. 5B, a width W1*a* of the opening portion of the first ink receiving groove 51*a* is greater than a width W2*a* of the opening portion of the second ink receiving groove 52*a*. On the other hand, a width W1*b* of the bottom portion of the first ink receiving groove 51*a* is same as a width W2*b* of the bottom portion of the second ink receiving groove 52*a*. As a result, a volume of the first ink receiving groove 51*a* (a cross-sectional area on a plane orthogonal to the longitudinal direction of the groove) is greater than a volume of each of the second ink receiving grooves 52*a*.

<Suction Purge Process>

Figure 6:
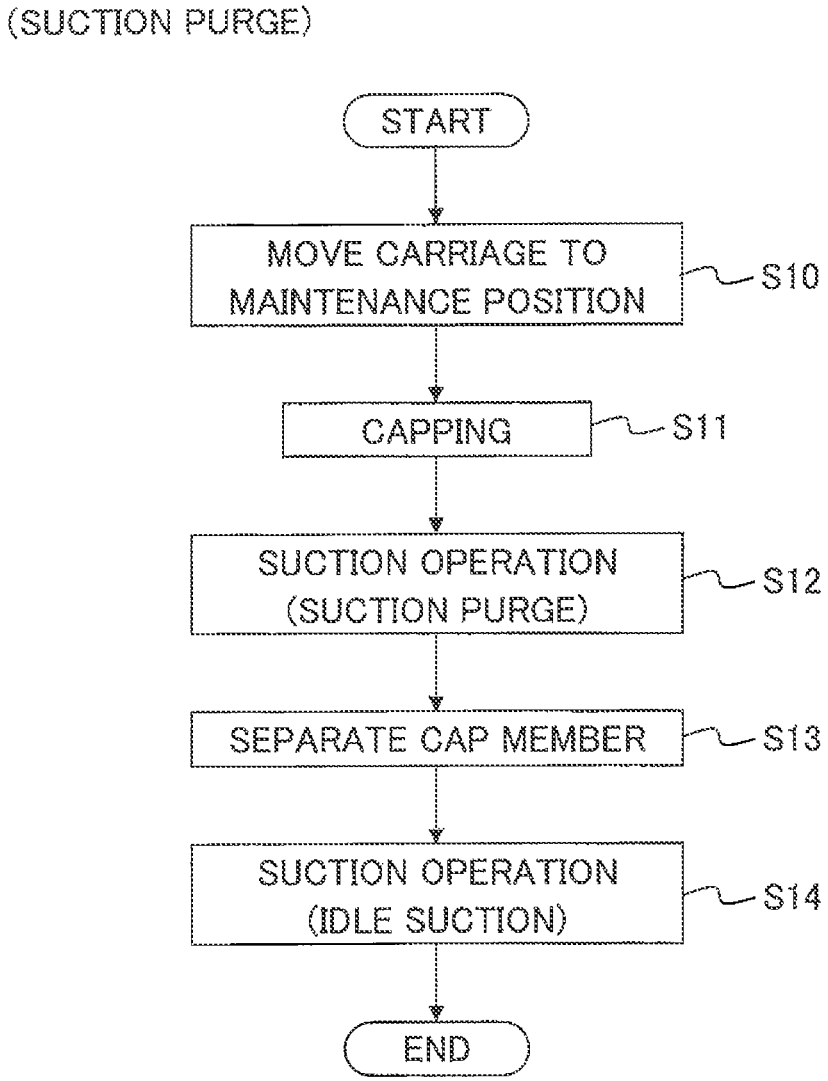
FIG. 6 is a flowchart of a suction purge.
Figure 7:
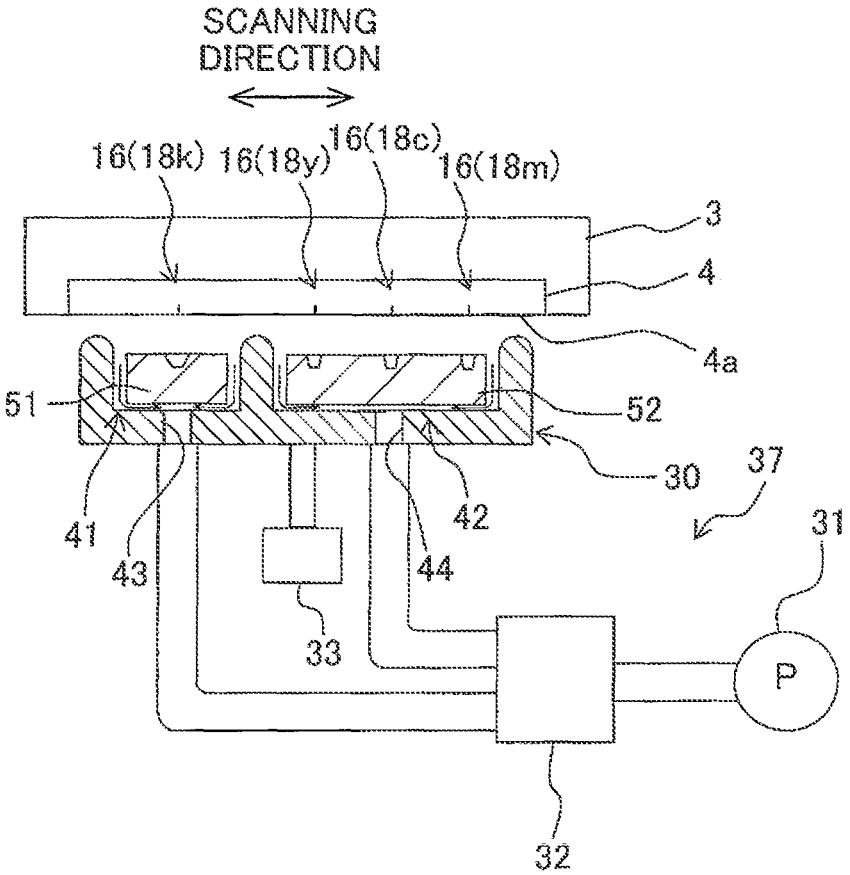
FIG. 7 is a diagram showing the ink-jet head and the cap member at the time of idle suction.

Next, a control flow at the time of carrying out suction purge will be described below by referring to a flowchart in FIG. 6. Si (where, i=10, 11, 12 . . . ) in the flowchart in FIG. 6, and a flowchart in FIG. 8 denotes a number of each step.

The suction purge is to be carried out in a case in which a jetting defect is detected in any of the nozzles 16, or in a case in which a possibility of occurrence of jetting defect is high. For instance, the suction purge is to be carried out in a case in which an instruction for carrying out the suction purge has been inputted by a user via the operation panel 35, or the PC 36, or in a case in which a predetermined time has elapsed after the previous suction purge was carried out.

At the time of carrying out the suction purge, the control unit 7 moves the carriage to a maintenance position (Pm in FIG. 1) by controlling the carriage driving motor 15 so that the ink jetting surface 4*a* of the ink-jet head 4 faces the cap member 30 (step S10). Next, the control unit 7 controls the cap driving motor 33 to elevate the cap member 30 and to make the capping state in which the cap member 30 makes a close contact with the ink jetting surface 4*a* (step S11).

Next, the control unit 7 reduces the pressure inside the cap member 30 by operating the suction pump 31, and carries out the suction purge (step S12). The suction purge may be carried out for both the nozzle row 18*k* for black ink and the nozzle rows 18*y*, 18*e*, and 18*m* for color inks, or may be carried out for one of the nozzle row 18*k* for black ink and the nozzle rows 18*y*, 18*c*, and 18*m* for color inks. When it is necessary to carry out the suction purge for both the nozzle row 18*k* for black ink and the nozzle rows 18*y*, 18*c*, and 18*m* for color inks, as the suction purge for one of the nozzle rows 18 is finished, the destination (access point) of the suction pump 31 is to be switched by the switching unit 32 as in the capping state, and the suction purge for the other nozzle rows 18 is to be carried out continuously.

When the suction purge is finished, an idle suction described below is carried out. The idle suction is an operation of sucking and discharging the ink accumulated in the cap member 30 by activating the suction pump 31 in a state that inside of the cap member 30 is released to an atmosphere. The control unit 7 controls the cap driving motor 33 to descend the cap member 30, and separates the cap member 30 from the ink jetting surface 4*a* (step S13). By doing this, an internal space of the cap member 30 is released to the atmosphere. In this state, the control unit 7 activates the suction pump 31 to suck and discharge the ink inside the cap member 30 (step S14). In a case in which the suction purge is carried out for both the nozzle row 18*k* for black ink and the nozzle rows 18*y*, 18*c*, and 18*m* for color inks at step S12, the ink is accumulated in both of the first cap portion 41 and the second cap portion 42. Therefore, the destination of the suction pump 31 is switched by the switching unit 32, and the idle suction is carried out for both of the first cap portion 41 and the second cap portion 42 separately.

Even after the idle suction is carried out, sometimes the ink is remained in a portion (a corner portion in particular) of the first cap portion 41 and the second cap portion 42. However, in the embodiment, since the first ink guiding member 51 and the second ink guiding member 52 are accommodated in the first cap portion 41 and the second cap portion 42 respectively, the narrow channel (gap) leading to the suction port 43 is formed between the inner surface of the first cap portion 41 and the first ink guiding member 51, and the narrow channel leading to the suction port 44 is formed between the inner surface of the second cap portion 42 and the second ink guiding member 52. The narrow channels act as channels when the ink inside the first cap portion 41 and the second cap portion 42 flows to the suction ports 43 and 44 respectively. Since the strong capillary force acts on the ink in such narrow channels, the ink remained in the corner portions of the first cap portion 41 and the second cap portion 42 is susceptible to be sucked to the suction ports 43 and 44.

<Flushing Process>

Figure 8:
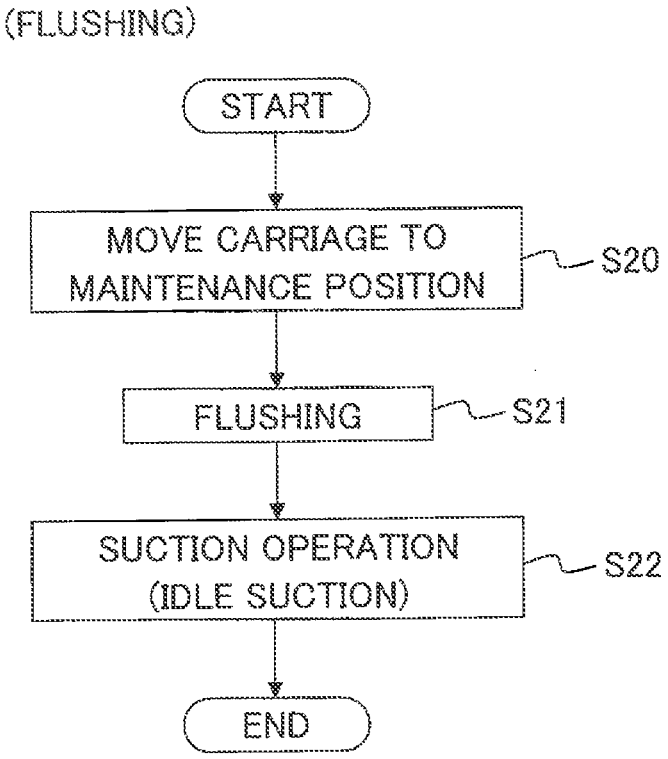
FIG. 8 is a flowchart of flushing.
Figure 9:
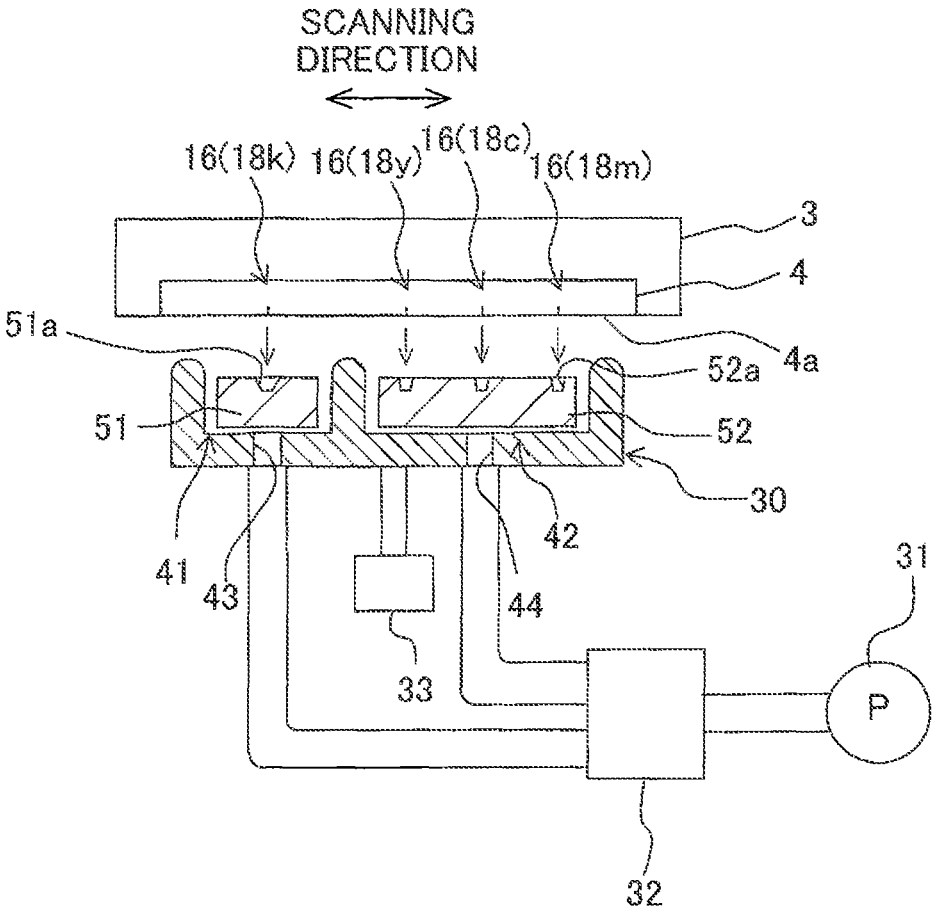
FIG. 9 is a diagram showing the ink-jet head and the cap member at the time of flushing.

Next, a control flow at the time of carrying out flushing will be described below by referring to a flowchart in FIG. 8.

A timing at which the flushing is to be carried out is not restricted particularly. However, in order to prevent jetting defects due to drying inside the nozzles 16, in most of the cases, the flushing is carried out immediately before printing on the recording paper 100. Or, usually, the flushing is carried out while the ink-jet head 4 carries out printing on the recording paper 100. For instance, the flushing is carried out every time the carriage 3 has moved by certain number of passes in the scanning direction during the printing on one recording paper 100.

As it has been aforementioned, in the embodiment, the cap member 30 used for the suction purge is also used as a liquid receiving member which receives the ink jetted from the nozzle 16 at the time of flushing. At the time of flushing, the control unit 7 controls the carriage driving motor 15 to move the carriage 3 to the maintenance position (Pm in FIG. 1) so that the cap member 30 faces the ink-jetting surface 4*a* of the ink-jet head 4 (step S20). At this time, the nozzle row 18*k* for black ink faces the first ink receiving groove 51*a* on the upper surface of the first ink guiding member 51. Moreover, the nozzle rows 18*y*, 18*c*, and 18*m* for three color inks face the three second ink receiving grooves 52*a* on the upper surface of the second ink guiding member 52, respectively.

Next, the control unit 7 controls the ink-jet head 4 to jet the ink from the plurality of nozzles 16 (step S21). In this flushing, unlike in the suction purge, it is not necessary for the cap member 30 to be in the capping state. In the first cap portion 41, the black ink is jetted from the plurality of nozzles 16 belonging to the nozzle row 18*k*, toward the first ink receiving groove 51*a* positioned just below the plurality of nozzles 16 in the nozzle row 18*k*. In the second cap portion 42, the yellow ink is made to be jetted from the plurality of nozzles 16 belonging to the nozzle row 18*y*, toward the second ink receiving groove 52*a* positioned just below the plurality of nozzles 16 in the nozzle row 18*y*. Similar to the nozzle row 18*y*, with respect to the nozzle row 18*c* for cyan and the nozzle row 18*m* for magenta, the cyan ink and the magenta ink are jetted toward the second ink receiving grooves 52*a* positioned just below the plurality of nozzles 16 in the nozzle row 18*c* and the nozzle row 18*m*, respectively. The flushing may sometimes be carried out for both of the nozzle row 18*k* for black ink and the nozzle rows 18*y*, 18*c*, and 18*m* for color inks, and may sometimes be carried out for either the nozzle row 18*k* for black ink or the nozzle rows 18*y*, 18*c*, and 18*m* for color inks. There is no need to carry out flushing for the nozzle rows 18*y*, 18*c*, and 18*m* for color inks which are not used during the black-and-white printing in which only the nozzle rows 18*k* for black ink are used.

Moreover, in the embodiment, the black ink is a pigment ink and is easy to dry as compared with the color inks of dye inks. Therefore, the control unit 7 controls such that an amount of ink jetted in flushing (number of flushing ejections) from each nozzle 16 in the nozzle row 18*k* of black ink, is greater than an amount of ink jetted from each nozzle 16 in the nozzle rows 18*y*, 18*c*, and 18*m* of color inks.

The flushing at step S21 may be carried out before the ink-jet head 4 completely stops in a state of facing the cap member 30 at step S20. In other words, the flushing of the four nozzle rows 18 may be started immediately before the four nozzle rows 18 come to a position just above the corresponding first ink receiving groove 51*a* and three second ink receiving grooves 52*a*. By doing this, it is possible to shorten the time required for flushing during printing in particular.

As the flushing is finished, the control unit 7 carries out idle suction by activating the suction pump 31 for discharging the ink accumulated inside the cap member 30. When the flushing has been carried out for both of the nozzle row 18*k* for black ink and the nozzle rows 18*y*, 18*c*, and 18*m* for color inks, the ink is accumulated in both of the first cap portion 41 and the second cap portion 42. Therefore, the idle suction is carried out for both the first cap portion 41 and the second cap portion 42 by switching the destination of the suction pump 31 by the switching unit 32.

Here, in a case in which the ink jetted from the nozzles 16 is adhered to the upper surfaces of the first ink guiding member 51 and the second ink guiding member 52 during the flushing, it is difficult to discharge all the adhered ink by the idle suction, and some of the ink remains on the upper surfaces of the first ink guiding member 51 and the second ink guiding member 52. However, in the embodiment, at the time of flushing, the ink is jetted from the nozzles 16 toward the first ink receiving groove 51*a* and second ink receiving grooves 52*a* formed in the first ink guiding member 51 and the second ink guiding member 52, respectively. Therefore, most of the ink jetted toward the cap member 30 at the time of flushing is accumulated in the first ink receiving groove 51*a* and the second ink receiving grooves 52*a*. Moreover, when the idle suction is carried out after the flushing, the capillary force acts strongly on the ink inside the first ink receiving groove 51*a* and the second ink receiving grooves 52*a*, and the ink inside the first ink receiving groove 51*a* and the second ink receiving grooves 52*a* is guided to the suction ports 43 and 44, respectively. Accordingly, the ink jetted toward the cap member 30 at the time of flushing is not easy to remain on the surfaces of the first ink guiding member 51 and the second ink guiding member 52.

Moreover, as shown in FIG. 3, the first ink receiving groove 51*a* and the second ink receiving grooves 52*a* extend in the longitudinal direction (alignment direction of the nozzles) of the first ink guiding member 51 and the second ink guiding member 52. Therefore, the ink jetted to the first ink receiving groove 51*a* and the second ink receiving grooves 52*a* at the time of flushing is guided to the gaps between the two end surfaces of each of the first ink guiding member 51 and the second ink guiding member 52 and the inner surfaces of the cap member 30, and is easy to be guided to the suction ports 43 and 44.

Moreover, in the embodiment, the amount of ink jetted from each nozzle 16 of the nozzle row 18*k* for black ink is greater than the amount of ink jetted from each nozzle 16 of the nozzle rows 18*y*, 18*c*, and 18*m* for three color inks. In other words, the amount of ink jetted toward the one first ink receiving groove 51*a* formed in the first ink guiding member 51 from the corresponding nozzle row 18 is greater than the amount of ink jetted from the corresponding nozzle 18 toward one of the second ink receiving grooves 52*a* formed in the second ink guiding member 52. In this regard, in the embodiment, the volume of the first ink receiving groove 51*a* is greater than the volume of each of the second ink receiving grooves 52*a* (groove cross-sectional area) as shown in FIGS. 5A and 5B. Consequently, the ink is prevented from overflowing from the first ink receiving groove 51*a* into which greater amount of ink is jetted at the time of flushing.

Moreover, as shown in FIG. 5A and FIG. 5B, the width W1*a* of the opening portion of the first ink receiving groove 51*a* is greater than the width W2*a* of the opening portion of the second ink receiving groove 52*a*. Therefore, the volume of the first ink receiving groove 51*a* is greater than the volume of the second ink receiving groove 52*a*. On the other hand, the width W1*b* of the bottom portion of the first ink receiving groove 51*a* is same as the width W2*b* of the bottom portion of the second ink receiving groove 52*a*. Therefore, in the two types of ink receiving grooves namely the first ink receiving groove 51*a* and the second ink receiving grooves 52*a*, the capillary forces acting on the ink accumulated at the bottom portions thereof are almost same. In other words, in the two types of ink receiving grooves namely the first ink receiving groove 51*a* and the second ink receiving grooves 51*b* having different volumes, it is possible to make ink discharge characteristics identical.

Moreover, in the embodiment, when the cap member 30 faces the ink jetting surface 4*a*, the nozzle row 18*k* for black ink faces the first ink receiving groove 51*a*, and the nozzle rows 18*y*, 18*c*, and 18*m* for three color inks face the three second ink receiving grooves 52*a*, respectively. Therefore, for carrying out the flushing with respect to each of the nozzle rows 18 for four colors, it is not necessary to change relative positions of the ink-jet head 4 and the cap member 30 by moving the carriage 3 in the scanning direction. Consequently, it is possible to carry out the flushing of the nozzle rows 18 for four colors simultaneously.

Next, modified embodiments in which various modifications are made in the embodiment will be described below. However, same reference numerals are assigned to components which are similar as in the embodiment, and description of such components is omitted.

First Modified Embodiment

In the embodiment, at the time of flushing, the amount of ink jetted from the nozzle row 18*k* for black ink is greater than the amount of ink jetted from each of the nozzle rows 18*y*, 18*c*, and 18*m* for color inks. However, the amount of ink jetted from each of the nozzle rows 18*y*, 18*c*, and 18*m* for color inks may be greater than the amount of ink jetted from the nozzle row 18*k* for black ink.

For instance, after carrying out the suction purge, sometimes a small amount of waste ink that has been discharged to the cap member 30 once flows in the reverse direction and enters the nozzles 16. For discharging the ink flowed in the reverse direction from the nozzles 16, the flushing is carried out after the suction purge. At this time, when an arrangement is such that the second cap portion 42 covers the nozzle rows 18*y*, 18*c*, and 18*m* for three colors commonly as in the embodiment, a waste ink of a color different from the ink to be jetted flows in each of the nozzle rows 18*y*, 18*c*, and 18*m*, and there is a mixing of colors. Therefore, to eliminate assuredly the mixing of colors, sometimes the amount of ink to be jetted from each of the nozzle rows 18*y*, 18*c*, and 18*m* for three color inks may be made greater than the amount of ink to be jetted from the nozzle row 18*k* for black ink.

In a case in which the amount of ink to be jetted from each of the nozzle rows 18*y*, 18*c*, and 18*m* for color inks is greater than the amount of ink to be jetted from the nozzle row 18*k* for black ink as in the aforementioned example, it is preferable to make the volume of each of the second ink receiving grooves 52*a* corresponding to the nozzle rows 18*y*, 18*e*, and 18*m* for color inks greater than the volume of the first ink receiving groove 51*a* corresponding to the nozzle 18*k* for black ink.

Second Modified Embodiment

It is not necessary for the number of nozzle rows 18 to be the same as the number of ink receiving grooves 51*a* (52*a*) which receive the ink jetted from the nozzle rows 18 at the time of flushing. For instance, in FIG. 10, two nozzle rows 18*k* for black ink are formed in the ink jetting surface 4*a*, and one first ink receiving groove 51*a* is formed in the first ink guiding member 51 inside the first cap portion 41 to face both of the two nozzle rows 18*k*. Moreover, at the time of flushing, the ink is jetted toward the one first ink receiving groove 51*a* from the two nozzle rows 18*k* for black ink.

Figure 11:
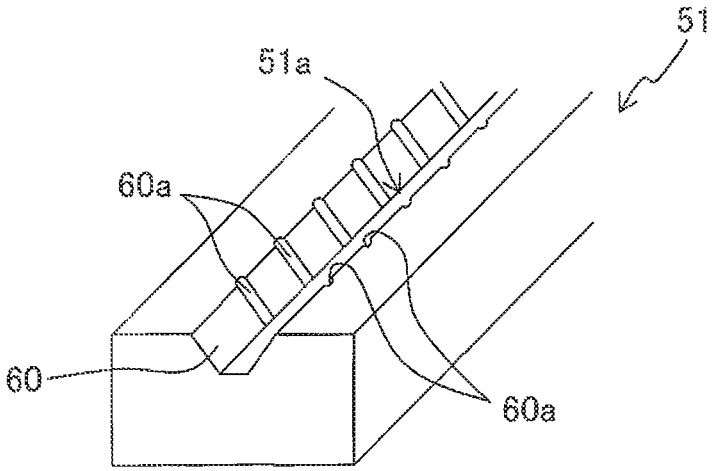
FIG. 11 is a perspective view of an ink guiding member in FIG. 10.

When the plurality of nozzle rows 18*k* face one first ink receiving groove 51*a*, it is necessary to make the width of the opening portion of the first ink receiving groove 51*a* large. On the other hand, from a view point of making the capillary force act greatly on the ink, it is not desirable to make the width of the bottom portion of the first ink receiving groove 51*a* too large. Consequently, an inner side surface of the first ink receiving groove 51*a* becomes a surface which is substantially inclined with respect to a vertical plane. In this case, the ink jetted toward the first ink receiving groove 51*a* from the nozzle row 18*k* tends to land on the inclined inner side surface. Therefore, for dropping down the ink landed on the inner side surface to the bottom portion assuredly, a plurality of guiding grooves 60*a* directed toward the bottom portion may have been formed in the inner side surface 60 of the first ink receiving groove 51*a* as shown in FIG. 11.

Figure 10:
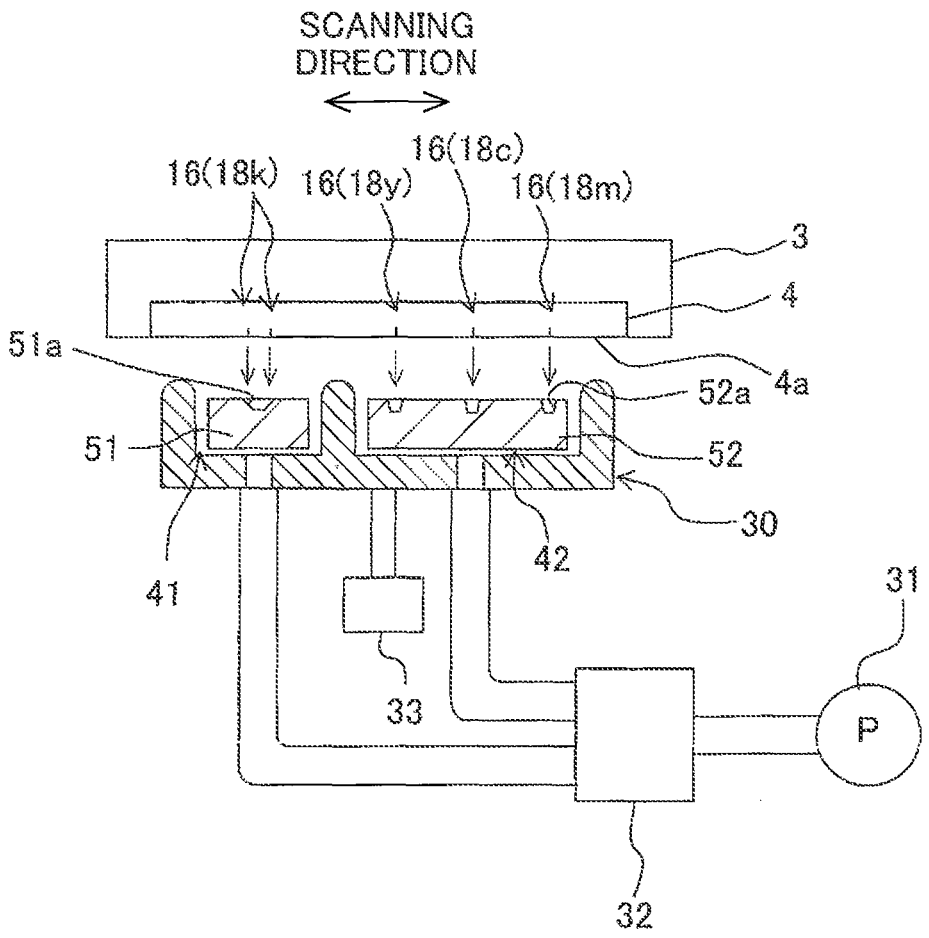
FIG. 10 is a diagram of a second modified embodiment corresponding to FIG. 9.

Moreover, in a case in which the number of nozzle rows 18*k* for black ink is greater than the number of each of the nozzle rows 18*y* for yellow ink, the nozzle rows 18*c* for cyan ink, and the nozzle rows 18*m* for magenta ink as in FIG. 10, even according to the difference in the number of nozzles 16, the amount of ink jetted to the first ink receiving groove 51*a* becomes greater than the amount of ink jetted to each of the second ink receiving grooves 52*a*. In other words, in the present invention, a situation in which the amount of ink jetted to the first ink receiving groove 51*a* is greater than the amount of ink jetted to the second ink receiving groove 52*a*, may occur not only due to the difference in the amounts of inks jetted from each nozzle 16 for black ink and each nozzle 16 for color inks as described in the embodiment, but also due to a difference in the number of nozzles 16 (nozzle rows 18) corresponding to the first ink receiving groove 51*a*.

Third Modified Embodiment

Figure 12:
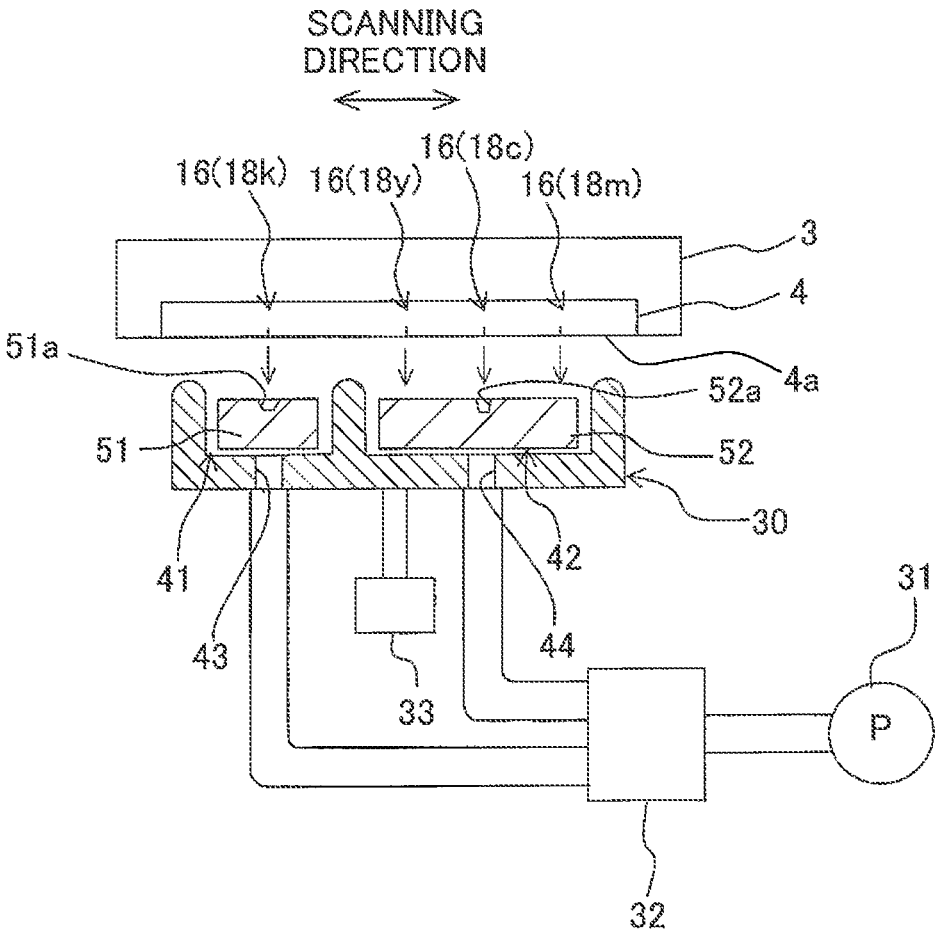
FIG. 12 is a diagram of a third modified embodiment corresponding to FIG. 9.

When the ink jetting surface 4*a* of the ink-jet head 4 faces the cap member 30, all the nozzle rows 18 may not face the first ink receiving groove 51*a* and the second ink receiving grooves 52*a*. For instance, in FIG. 12, only one second ink receiving groove 52*a* is formed on the upper surface of the second ink guiding member 52 with respect to the nozzle rows 18*y*, 18*c*, and 18*m* for three color inks. In this case, it is not possible to make the nozzle rows 18*y*, 18*c*, and 18*m* face one second ink receiving groove 52*a* simultaneously. However, an arrangement may be made such that only one of the nozzle rows 18 for which the flushing is to be carried faces the second ink receiving groove 52*a*, by moving the carriage 3 in the scanning direction to change the relative position of the cap member 30. For instance, in FIG. 12, a state, in which the nozzle row 18*c* for cyan ink faces the second ink receiving groove 52*a* and the flushing of the nozzle row 18*c* for cyan is carried out, is shown. Furthermore, in a case of carrying out flushing for the nozzle row 18*y* for yellow ink or for the nozzle row 18*m* for magenta ink, the nozzle row 18*y* (18*m*) for which the flushing is to be carried out faces the second ink receiving groove 52*a* by moving the carriage 3 in the scanning direction.

Fourth Modified Embodiment

Figure 13:
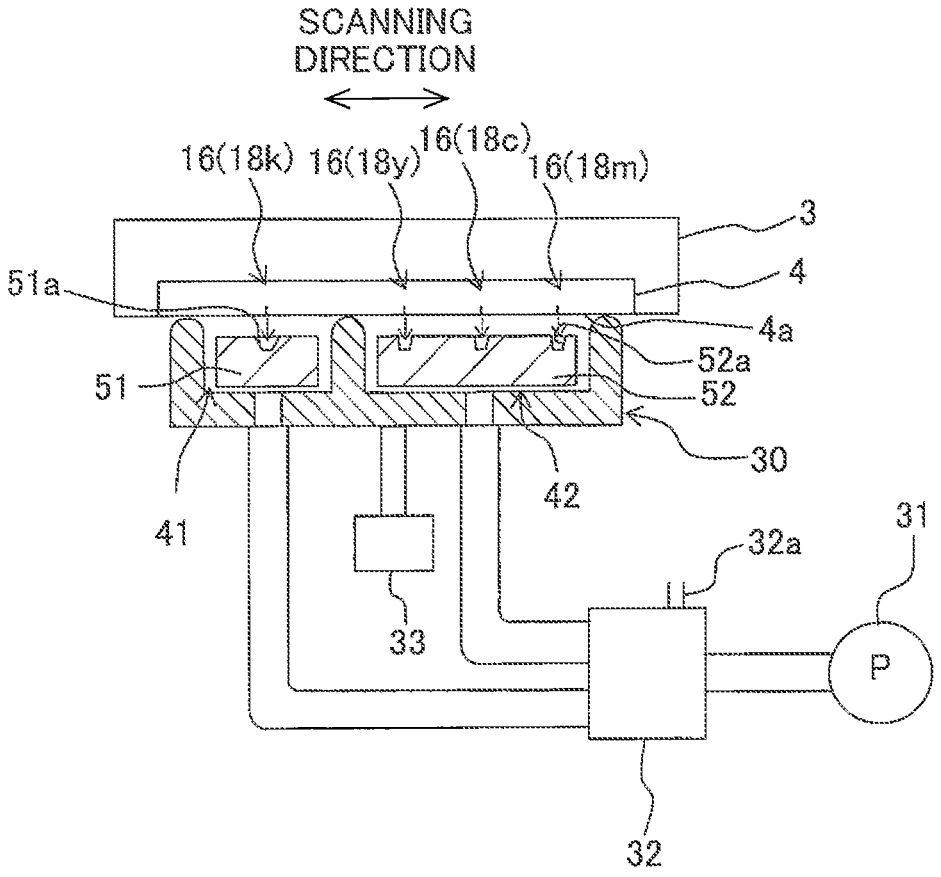
FIG. 13 is a diagram of a forth modified embodiment corresponding to FIG. 9.

In the embodiment, the flushing has been carried out in a state of the cap member 30 separated from the ink jetting surface 4*a*. However, the flushing may be carried out in the capping state with the cap member 30 in a close contact with the ink jetting surface 4*a*, as shown in FIG. 13. In this case, the ink jetted from the nozzles 16 at the time of flushing is prevented from being dispersed around the cap member 30.

Moreover, in a case of having an arrangement in which the internal space of the cap member 30 communicates with the atmosphere in the capping state in FIG. 13, it is also possible to carry out the idle suction in the capping state after the flushing is finished. In FIG. 13, an atmosphere-communicating portion 32*a* is provided to the switching unit 32 connected to the cap member 30. Moreover, the switching unit 32 has a switching valve (not shown in the diagram) which switches the first cap portion 41 or the second cap portion 42 connected to the suction pump 31 between a state of being cut-off from the atmosphere and a state of being in communication with the atmosphere via the atmosphere-communicating portion 32*a*. By activating the suction pump 31 in a state that the first cap portion 41 or the second cap portion 42 communicates with the atmosphere by the switching unit 32, it is possible to carry out idle suction of inside of the first cap portion 41 or the second cap portion 42 in the capping state. The atmosphere-communicating portion through which the inside of the cap member 30 communicates with the atmosphere is not necessarily required to be provided to the switching unit 32, and may be provided to the cap member 30 for instance.

Fifth Modified Embodiment

Figure 14:
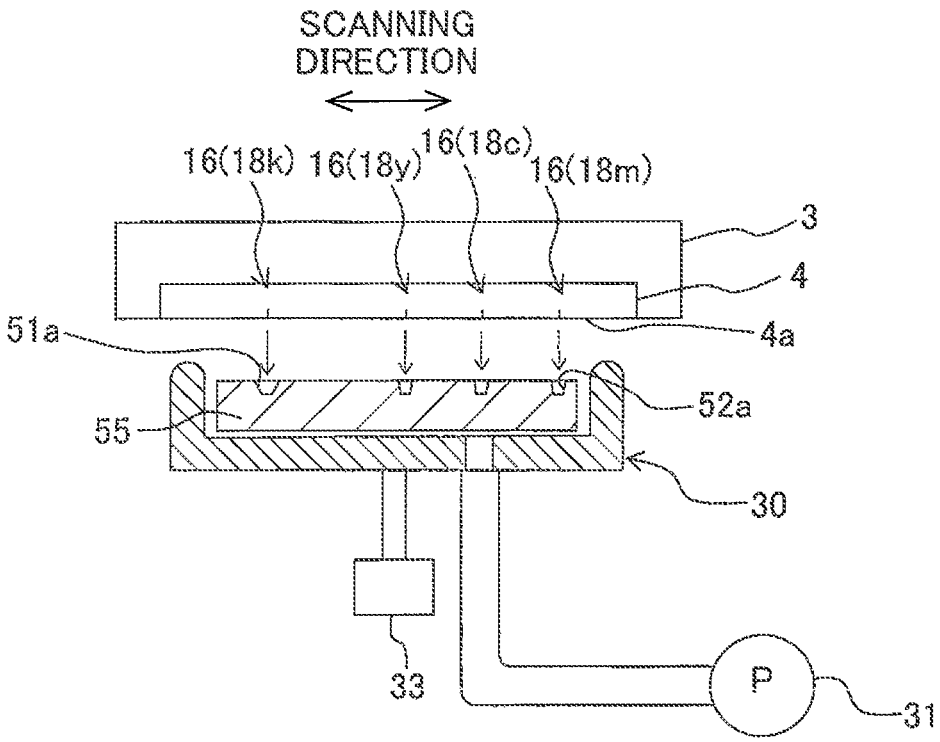
FIG. 14 is a diagram of a fifth modified embodiment corresponding to FIG. 9.

In the embodiment, the first cap portion 41 which covers the nozzle row 18*k* for black ink and the second cap portion 42 which covers the nozzle rows 18*y*, 18*c*, and 18*m* for three color inks have been separated by the partition wall portion 30*c*. However, as shown in FIG. 14, the cap member 30 may not be divided into the first cap portion 41 and the second cap portion 42. In FIG. 14, one ink guiding member 55 is accommodated in the cap member 30, and on an upper surface of the ink guiding member 55, one first ink receiving groove 51*a* corresponding to the nozzle row 18*k* for black ink and three second ink receiving grooves 52*a* corresponding to the nozzle rows 18*y*, 18*c*, and 18*m* for three color inks are formed.

Sixth Modified Embodiment

The shapes of the first ink receiving groove 51*a* and the second ink receiving groove 52*a* are not restricted to the shapes in the embodiment, and it is possible to make the following changes in the shapes.

Figure 15A:
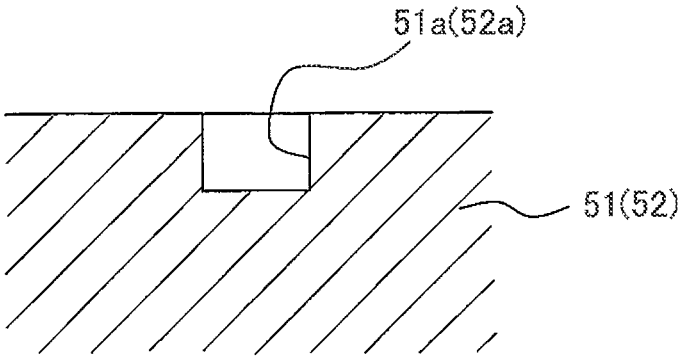
FIG. 15A and FIG. 15B are cross-sectional views of ink guiding members according a sixth modified embodiment.
Figure 15B:
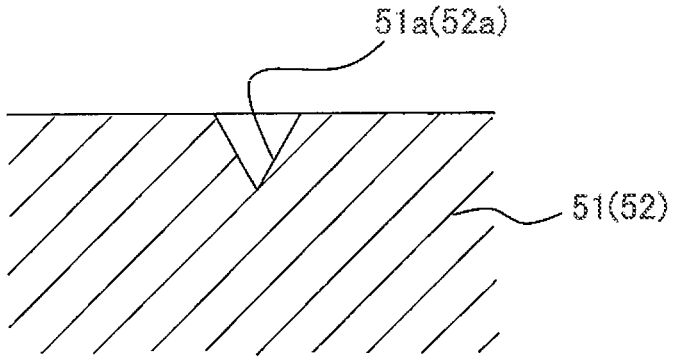

As shown in FIG. 15A, the first ink receiving groove 51*a* (the second ink receiving groove 52*a*) may have a rectangular cross-sectional shape in which the width of the opening portion is same as the width of the bottom portion thereof. Or, as shown in FIG. 15B, the first ink receiving groove 51*a* (the second ink receiving groove 52*a*) may have a triangular cross-sectional shape which is sharp (pointed) at a bottom portion and in which the width of the bottom portion extremely smaller than the width of the opening portion.

Seventh Modified Embodiment

Figure 16A:
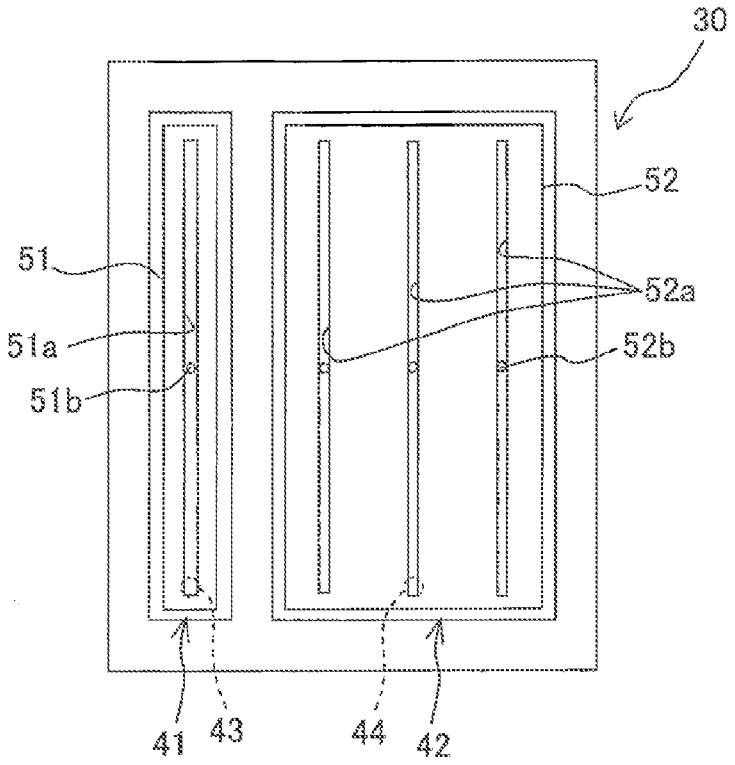
FIG. 16A and FIG. 16B are top views of ink guiding members according to a seventh modified embodiment.
Figure 16B:
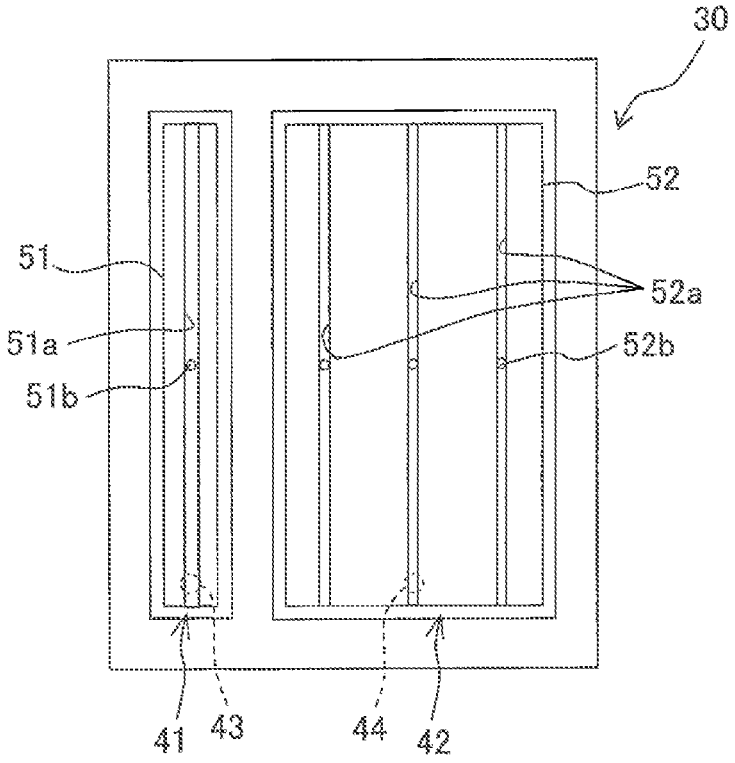

As shown in FIG. 16A, through holes 51*b* and 52*b* penetrating in a thickness direction of the first ink guiding member 51 and the second ink guiding member 52 respectively may be formed in the first ink receiving groove 51*a* and the second ink receiving grooves 52*a* respectively. In FIG. 16A, an example, in which one through hole 51*b* is provided in a central portion in the longitudinal direction of the first ink receiving groove 51*a* and one through hole 52*b* is provided in a central portion in the longitudinal direction of each of the second ink receiving grooves 52*a*, is shown. However, it is possible to set the number and positions of each of the through holes 51*b* and 52*b* appropriately. The through holes 51*b* and 52*b* may extend in a direction perpendicular to the ink jetting surface 4*a*, or may be inclined with respect to the direction perpendicular to the ink jetting surface 4*a*, as long as the through holes 51*b* and 52*b* penetrate the first ink guiding member 51 and the second ink guiding member 52 respectively in the thickness direction of the first ink guiding member 51 and the second ink guiding member 52. In this case, the ink accumulated in the first ink receiving groove 51*a* and the second ink receiving groove 52*a* is guided to a rear side of the first ink guiding member 51 and the second ink guiding member 52 respectively via the through holes 51*b* and 52*b*, and further guided to the suction ports 43 and 44. As shown in FIG. 16B, the through holes 51*b* and 52*b* may be provided in the first ink receiving groove 51*a* and the second ink receiving grooves 52*a* respectively and also, the first ink receiving groove 51*a* and the second ink receiving grooves 52*a* may extend up to two ends of the first ink guiding member 51 and the second ink guiding member 52 in the alignment direction of the nozzles. In this case, the through holes 51*b* and 52*b* may extend in a direction perpendicular to the ink jetting surface 4*a*, or may be inclined with respect to the direction perpendicular to the ink jetting surface 4*a*, as long as the through holes 51*b* and 52*b* penetrate the first ink guiding member 51 and the second ink guiding member 52 respectively in the thickness direction of the first ink guiding member 51 and the second ink guiding member 52.

Eighth Modified Embodiment

The purge in which the ink is discharged forcibly from the nozzles 16 of the inkjet head 4 is not restricted to the suction purge which is carried out by reducing the pressure inside the cap member 30. In other words, the purge may be a so-called pressurized purge in which the ink is discharged forcibly from the nozzles 16 by pressurizing the ink from an ink channel at an upstream side of the nozzle 16.

Ninth Modified Embodiment

In the embodiment, the inkjet head 4 is a so-called serial-type head which has the nozzle rows 18 each extending in the transport direction and which is moved in the scanning direction with respect to the recording paper 10. However, the ink-jet head 4 may be a so-called line-type head having a nozzle row 18 extending in a width direction of the recording paper 100 (direction orthogonal to the transport direction).

The embodiment and the modified embodiments described above are examples in which the present invention is applied to an ink-jet printer which prints image etc. by jetting an ink onto a printing paper. However, the present invention is also applicable to liquid jetting apparatuses which are used for various applications other than printing of image etc. For example, the present invention is also applicable to a liquid jetting apparatus which forms an electroconductive pattern on a surface of a substrate by jetting an electroconductive liquid onto the substrate.

What is claimed is:

1. A liquid jetting apparatus comprising:

a liquid jetting head having a liquid jetting surface in which a first nozzle row and a second nozzle row are formed, each of the first nozzle row and the second nozzle row including a plurality of nozzles aligned in a predetermined direction;

a cap member configured to be in a close contact with the liquid jetting surface to cover the first nozzle row and the second nozzle row;

a liquid discharge section connected to the cap member;

a liquid guiding member accommodated in the cap member; and a control unit configured to control the liquid jetting head to jet a liquid from each of the first nozzle row and the second nozzle row;

wherein a first liquid receiving groove extending in the predetermined direction and a second liquid receiving groove extending in the predetermined direction and having a volume smaller than a volume of the first liquid receiving groove are formed in a facing surface of the liquid guiding member, the facing surface being configured to face the liquid jetting surface;

wherein the control unit is configured to control the liquid jetting head to jet the liquid from the first nozzle row toward the first liquid receiving groove and to jet the liquid from the second nozzle row toward the second liquid receiving groove at a time of flushing of the nozzles;

wherein the control unit is configured to control the liquid jetting head such that, at the time of flushing, an amount of liquid jetted from the first nozzle row toward the first liquid receiving groove is greater than an amount of liquid jetted from the second nozzle row toward the second liquid receiving groove;

wherein the cap member includes:

a first cap portion configured to cover the first nozzle row;

a second cap portion being separated from the first cap portion by a partition wall portion and configured to cover the second nozzle row;

a first liquid guiding member accommodated in the first cap portion; and a second liquid guiding member accommodated in the second cap portion;

wherein the first liquid receiving groove is formed in the facing surface of the first liquid guiding member;

wherein the second liquid receiving groove is formed in the facing surface of the second liquid guiding member;

wherein a width of an opening of the first liquid receiving groove in a direction orthogonal to the predetermined direction is greater than a width of an opening of the second liquid receiving groove in the direction orthogonal to the predetermined direction; and wherein a width of a bottom of the first liquid receiving groove in the direction orthogonal to the predetermined direction is same as a width of a bottom of the second liquid receiving groove in the direction orthogonal to the predetermined direction.

2. The liquid jetting apparatus according to claim 1;

wherein the first nozzle row and the second nozzle row are arranged in a direction orthogonal to the predetermined direction in the liquid jetting surface of the liquid jetting head; and wherein the first liquid receiving groove and the second liquid receiving groove are arranged on the facing surface of the liquid guiding member in the direction orthogonal to the predetermined direction such that the first nozzle row faces the first liquid receiving groove and the second nozzle row faces the second liquid receiving groove, in a state that the cap member is facing the liquid jetting surface.

3. The liquid jetting apparatus according to claim 1;

wherein the liquid discharge section includes a suction mechanism connected to the cap member; and wherein, after the completion of the flushing, the suction mechanism is configured to suck and discharge a liquid inside the cap member.

4. The liquid jetting apparatus according to claim 1;

wherein a through hole penetrating through the liquid guiding member in a thickness direction of the liquid guiding member is formed in each of the first liquid receiving groove and the second liquid receiving groove.

5. The liquid jetting apparatus according to claim 4;

wherein the thickness direction of the liquid guiding member is perpendicular to the liquid jetting surface.

6. The liquid jetting apparatus according to claim 1;

wherein each of the first liquid receiving groove and the second liquid receiving groove extends up to both ends in the predetermined direction of the liquid guiding member.

7. The liquid jetting apparatus according to claim 1;

wherein the plurality of nozzles included in the first nozzle row are arranged in a zigzag form in the predetermined direction; and wherein the plurality of nozzles included in the second nozzle row are arranged in a zigzag form in the predetermined direction.

8. The liquid jetting apparatus according to claim 1;

wherein the liquid to be jetted from the first nozzle row is a pigment ink and the liquid to be jetted from the second nozzle row is a dye ink.

9. The liquid jetting apparatus according to claim 8;

wherein the pigment ink is a black ink and the dye ink is a color ink.

10. A liquid jetting apparatus comprising:

a liquid jetting head having a liquid jetting surface in which a first nozzle row and a second nozzle row are formed, each of the first nozzle row and the second nozzle row including a plurality of nozzles aligned in a predetermined direction;

a cap member configured to be in a close contact with the liquid jetting surface to cover the first nozzle row and the second nozzle row;

a liquid discharge section connected to the cap member;

a liquid guiding member accommodated in the cap member; and a control unit configured to control the liquid jetting head to jet a liquid from each of the first nozzle row and the second nozzle row, wherein a first liquid receiving groove extending in the predetermined direction and a second liquid receiving groove extending in the predetermined direction and having a volume smaller than a volume of the first liquid receiving groove are formed in a facing surface of the liquid guiding member, the facing surface being configured to face the liquid jetting surface;

wherein the control unit is configured to control the liquid jetting head to jet the liquid from the first nozzle row toward the first liquid receiving groove and to jet the liquid from the second nozzle row toward the second liquid receiving groove at a time of flushing of the nozzles;

wherein the control unit is configured to control the liquid jetting head such that, at the time of flushing, an amount of liquid jetted from the first nozzle row toward the first liquid receiving groove is greater than an amount of liquid jetted from the second nozzle row toward the second liquid receiving groove; and wherein a plurality of guiding grooves directed toward a bottom of the first liquid receiving groove are formed in an inner side surface of the first liquid receiving groove.

11. The liquid jetting apparatus according to claim 1;

wherein a cross-sectional shape of each of the first liquid receiving groove and the second liquid receiving groove in a direction orthogonal to the predetermined direction is a rectangular shape in which a width of an opening in the direction orthogonal to the predetermined direction is same as a width of a bottom in the direction orthogonal to the predetermined direction.

12. The liquid jetting apparatus according to claim 1;

wherein a cross-sectional shape of each of the first liquid receiving groove and the second liquid receiving groove in a direction orthogonal to the predetermined direction is a triangular shape in which a width in the direction orthogonal to the predetermined direction decreases from an opening toward a bottom.

13. The liquid jetting apparatus according to claim 1;

wherein the second nozzle row is formed as a plurality of second nozzle rows;

wherein the second liquid receiving groove is formed as a plurality of second liquid receiving grooves; and wherein the number of the second liquid receiving grooves is same as the number of the second nozzle rows.

* * * * *